US012716681B2

(12) United States Patent
Sweeting et al.

(10) Patent No.: US 12,716,681 B2
(45) **Date of Patent: *Aug. 25, 2026**

(54) BREECHLESS PROJECTILE ALIGNMENT MODULE AND LAUNCH METHODS FOR TOY BLASTER APPARATUS

(71) Applicant: Hasbro, Inc., Pawtucket, RI (US)

(72) Inventors: Philip Sweeting, Medford, MA (US); David Drew Weiand, Johnston, RI (US)

(73) Assignee: Hasbro, Inc., Pawtucket, RI (US)

( * ) Notice: Subject to any disclaimer, the term of this patent is extended or adjusted under 35 U.S.C. 154(b) by 14 days.

This patent is subject to a terminal disclaimer.

(21) Appl. No.: 19/043,307

(22) Filed: Jan. 31, 2025

(65) Prior Publication Data

US 2025/0198725 A1 Jun. 19, 2025

Related U.S. Application Data

(62) Division of application No. 18/610,679, filed on Mar. 20, 2024, now Pat. No. 12,215,952.

(60) Provisional application No. 63/456,756, filed on Apr. 3, 2023.

(51) Int. Cl.

| | |
|---|---|
| ***F41B 11/641*** | (2013.01) |
| ***F41B 11/52*** | (2013.01) |
| ***F41B 11/73*** | (2013.01) |

(52) U.S. Cl.

CPC ..... *F41B 11/641* (2013.01); *F41B 11/52* (2013.01); *F41B 11/73* (2013.01)

(58) Field of Classification Search

CPC ..... F41B 11/643; F41B 11/642; F41B 11/54; F41B 11/60; F41B 11/62; F41B 11/66; F41B 11/68; F41B 11/73; F41B 11/52; F41B 11/641

USPC ..... 124/71

See application file for complete search history.

(56) References Cited

U.S. PATENT DOCUMENTS

| | | | | | |
|---|---|---|---|---|---|
| 1,743,576 | A | * | 1/1930 | Smith | F41B 11/53 124/72 |
| 1,873,677 | A | * | 8/1932 | Traver | F41B 11/55 24/523 |
| 3,584,614 | A | * | 6/1971 | Horvath | A63B 69/409 124/56 |
| 3,847,132 | A | * | 11/1974 | Schatz | A63B 69/409 124/81 |
| 4,841,945 | A | | 6/1989 | Braden | |

* cited by examiner

*Primary Examiner* — John Cooper
(74) *Attorney, Agent, or Firm* — Perry Hoffman

(57) ABSTRACT

Launcher apparatus and methods for a toy projectile blaster with a breechless projectile alignment module having a receptacle or hopper for multiple received projectile rounds, a passage at the alignment module including a barrel seal to align received projectiles for launching through a blaster barrel, and a channel into the alignment module for a compressed air source. A pre-firing area defines a junction inside the alignment module extending between the receptacle, the channel, and the barrel seal. An actuator at the housing is linked with the compressed air source for causing compressed air to expel through the channel into the alignment module and outwardly launch the received projectile rounds.

20 Claims, 19 Drawing Sheets

BREECHLESS PROJECTILE ALIGNMENT MODULE AND LAUNCH METHODS FOR TOY BLASTER APPARATUS

FIELD OF THE INVENTION

The present invention relates generally to launcher apparatus and methods for a toy projectile blaster discharging projectiles such as foam rounds, balls, and flexible projectiles including hydrated super absorbent polymer (SAP) beads, and more particularly, for discharging plural projectile rounds in a novel fashion providing for toy blaster breechless and continuous feeding of projectiles with projectile launch alignment apparatus and methods without the use of a mechanical breech.

BACKGROUND OF THE INVENTION

Toys are often designed to have play value by simulating a real object, safely and at a reasonable expense. Toy launch apparatus have been marketed as toys for decades and include such devices as water pistols, toy BB rifles, foam projectiles, balls discs, dart blasters and NERF® brand launchers that discharge a soft foam dart. Most air launchers discharging projectiles use a launch spring and a piston and cylinder arrangement to generate the energy and direct that energy to cause the projectile to discharge. The launching apparatus themselves come in various forms, including those simulating rifles, guns, machine gun, shotguns, bows, rocket launchers, grenade launchers and foam car launchers. Generally, from design and function standpoints control of the size and operation of an air chamber in the cylinder is desirable for efficiency and cost considerations.

Projectile launch mechanisms are known in the art and include mechanisms for launching toy darts, balls of various sizes, paint balls, etc. Known projectiles also include spheres of hydrated super absorbent polymer beads, such as those disclosed in U.S. Pat. Nos. 8,371,282 and 8,640,683. These patents are incorporated herein by reference. As explained in the patents, super absorbent polymer beads are able to absorb extremely large amount of liquid relative to their own mass through hydrogen bonding with water molecules. Super absorbent polymer beads are soft projectiles that can maintain their shape under modest pressure such that they can be projected with reasonable force and velocity without breaking apart. Such super absorbent polymers are often referred to as "hydrogels" or simply as "gels." Examples of toy gel bead devices, marketed by Hasbro Inc., under the brands NERF® PRO GELFIRE™, and GEL BALL BLASTER™, stylized toy rifles that launches gel balls or 'gelfire' rounds. In the alternative made of NERF™ brand foam, a solid, spongy cellular material.

The inventions discussed in connection with the described embodiments address these and other deficiencies of the prior art. The features and advantages of the present inventions will be explained in or become apparent from the following summary and description of the preferred embodiments considered together with the accompanying drawings. The projectiles for such launching apparatus include soft foam darts of various designs and sizes, foam balls, also of various sizes, and other soft projectiles.

SUMMARY OF THE INVENTION

In accordance with the present invention, an advantageous method and apparatus are provided in the form of a breechless launch apparatus designed to discharge soft projectiles, with an advantageous method and system are described in the form of an improved barrel seal is aligned with a passage at the alignment module. A pre-firing area is defined inside the alignment module extending between the receptacle and the at least one barrel seal. A channel into the alignment module capable of fluid communication with the compressed air source. The pre-firing area is enabled to align at least one of the received projectiles at the at least one barrel seal by gravity.

Briefly summarized, the inventions relate to a toy launching apparatus capable of launching projectile rounds fed from a generally sealed, pressurized hopper by a combination of gravity and air flow received through a receptacle defined atop the alignment module, allowing multiple projectile rounds to be received in an eloquent configuration with continuous feeding of projectiles. The breechless projectile launcher includes the barrel seal to align received projectiles for launching through a blaster barrel with the compressed air source for causing compressed air to expel through the channel into the alignment module and outwardly launch the received projectile rounds. An actuator at the housing and linked with the compressed air source for causing compressed air to expel through the channel into the alignment module and outwardly launch the one or more received projectile rounds through the at least one barrel seal and the launching barrel.

BRIEF DESCRIPTION OF DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

FIG. 7 shows an alternate modular assembly alignment module embodiment shown with a rectangular hopper.

FIGS. 9 through 13 further illustrate launching apparatus assembly operations in cross-section staging of sequenced projectile rounds.

FIGS. 15 through 17 further illustrates apparatus assembly operations with alternate hopper receptacle cover having an extending interior wall to modify and limit the volume of the hopper for more efficient control over pressure drop resulting before the blast of compressed air reaches the projectile for discharge with the shape of the hopper to reduce the performance drop off between the earlier and later shots from the hopper.

DETAILED DESCRIPTION OF THE EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
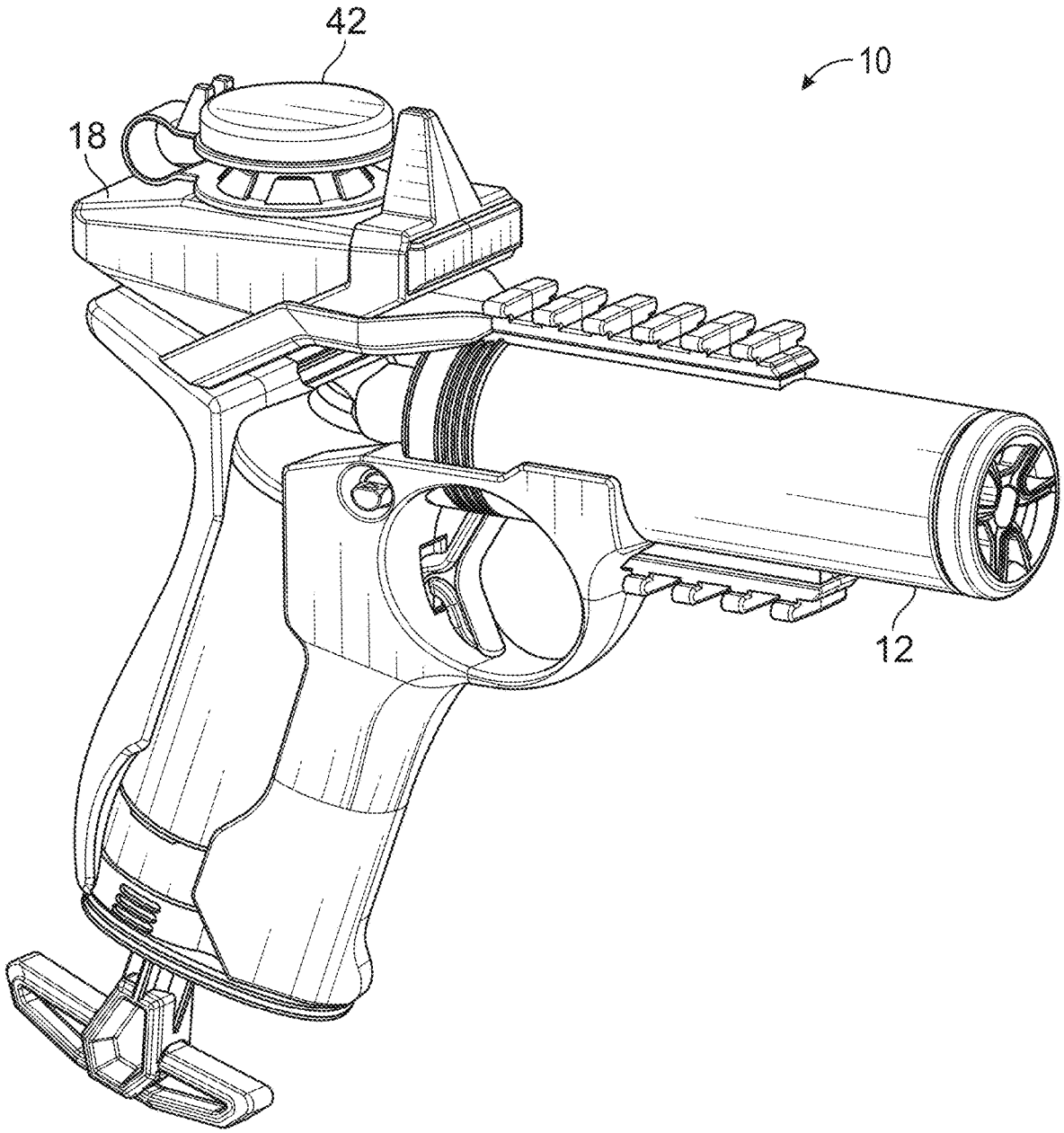
FIG. 1 is an isometric view of a preferred embodiment of the present invention in the form of a toy projectile blaster.
Figure 2:
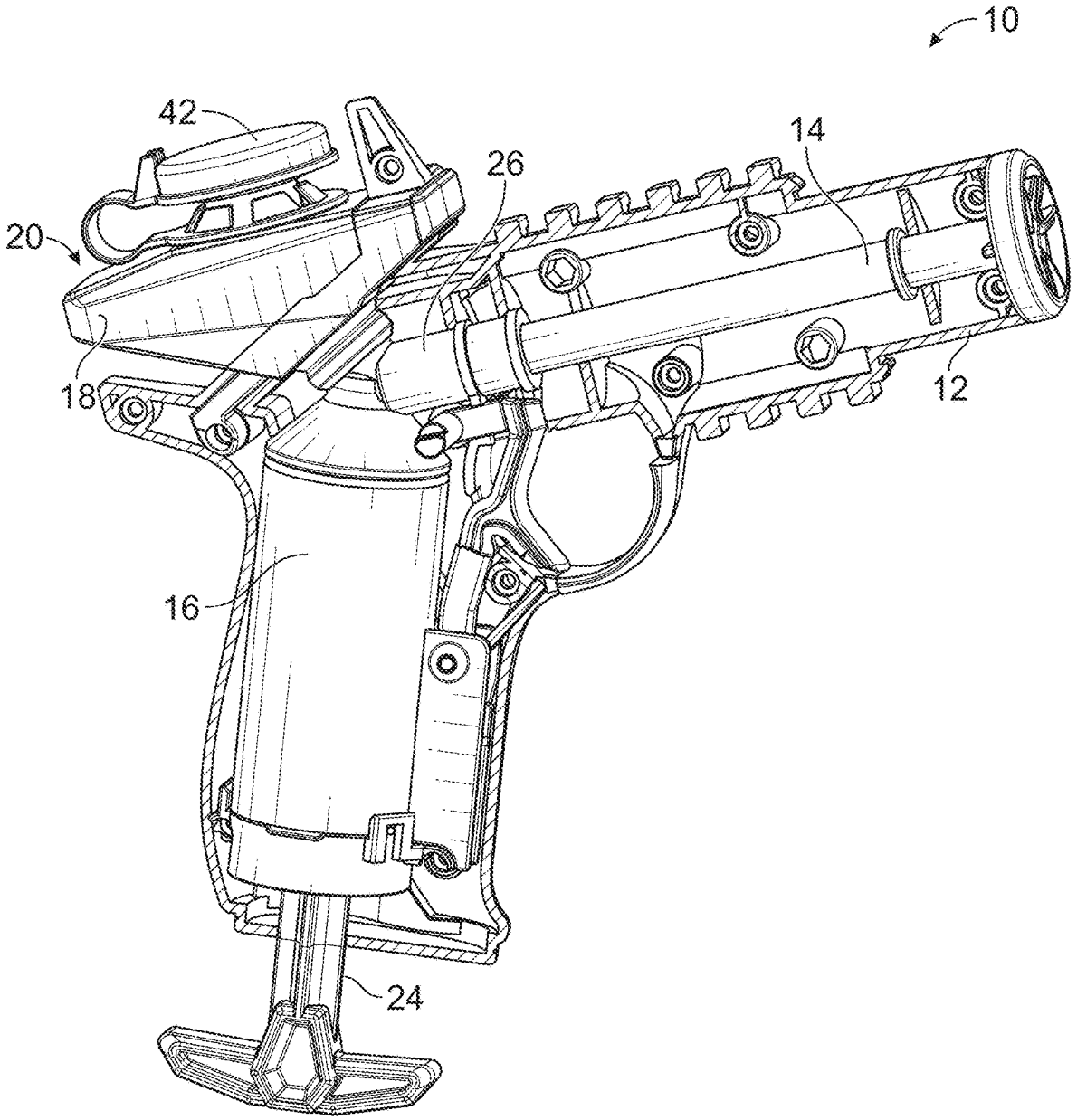
FIG. 2 is a diagrammatic side elevation view of a toy projectile blaster illustrated in FIG. 1, with a breechless projectile alignment module apparatus having half of the housing removed to reveal internal mechanisms.
Figure 3:
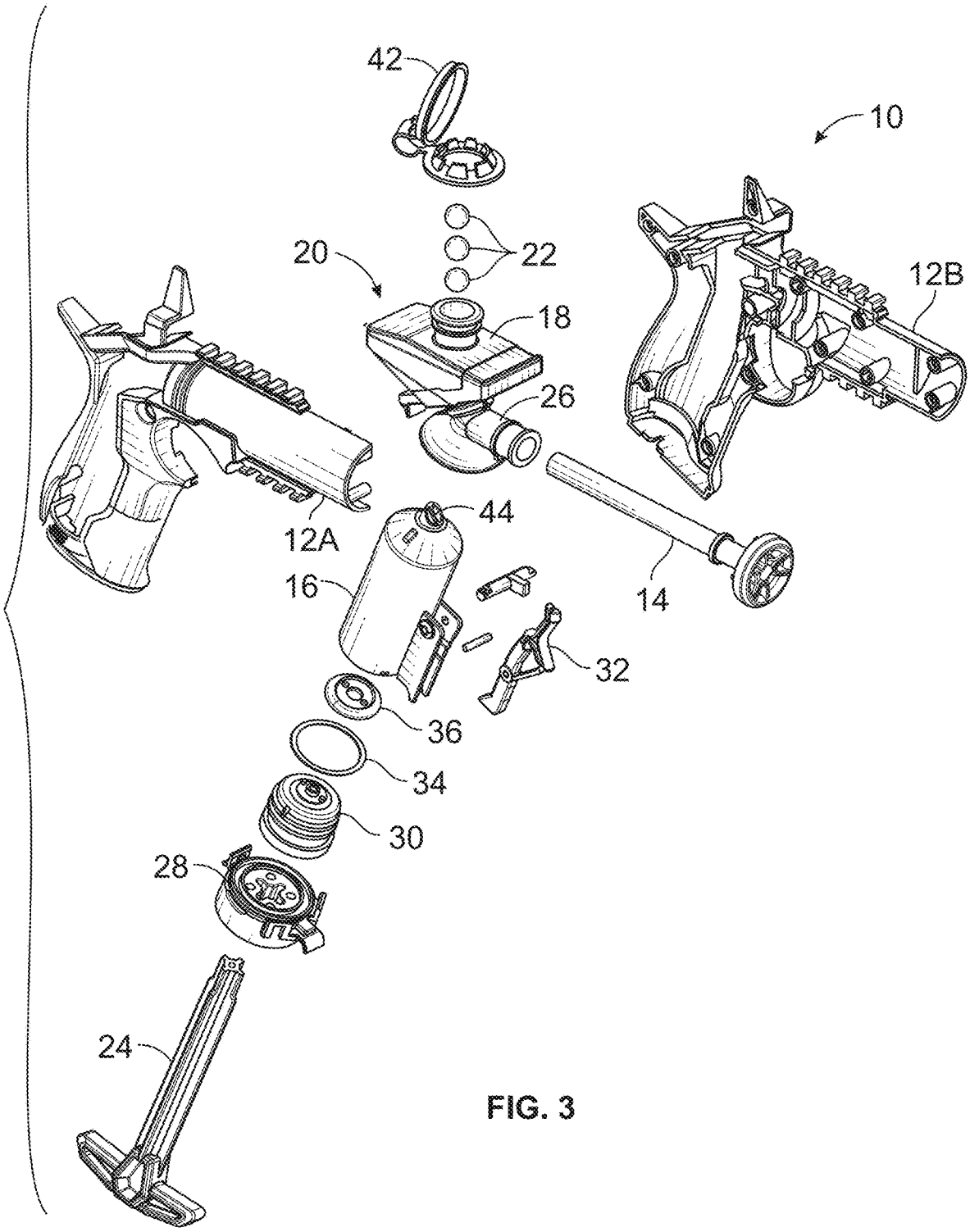
FIG. 3 shows an exploded view of the toy projectile blaster in which the launching apparatus is housed in the form a grip with the blaster sections therein.

FIG. 1 is an isometric view of a preferred embodiment breechless toy projectile blaster launching apparatus 10. Referring to FIGS. 1-3, the toy launching apparatus 10 is illustrated with a housing 12, 12A, 12B with a projectile alignment module 20 or firing module for launching one or more of multiple received projectile rounds 22 or balls. The alignment module 20 includes a receptacle 18 or hopper has the projectile rounds received into the alignment module, with the receptacle located along an upper portion of the alignment module. FIG. 2 is a diagrammatic side elevation view of the breechless projectile blaster launching apparatus 10 illustrated in FIG. 1 with the toy apparatus having half of the housing 12 removed to reveal internal mechanisms, with FIG. 3 showing an exploded view thereof. The exploded view of FIG. 3 reveals launching apparatus 10 illustrated with housing 12A, B formed with a grip section, and housing a barrel 14 or more broadly the launch site section, with a trigger 32 actuator at the housing 12. Within the grip section of the housing 12 there is a generic compressed air source. In the current embodiment, the generic compressed air source is provided as a cylinder 16 where mounted in the cylinder 16 is a piston 30, 34, 36 operable with a drive spring seated at cap plate closure 28 at the bottom of housing 12 and cylinder 16. The downward extending elongated handle 24 extends from the bottom 28 of the grip portion to allow piston drive spring operation by a user.

The implementation of the generic compressed air source should not be limited to the cylinder and piston configuration in the current embodiment. Other embodiments may provide the generic compressed air source as a motorized blower or a continuous slide. The generic compressed air source may be pulsed or continuous. An actuator may be provided for the generic compressed air source. The actuator may be provided as a trigger or otherwise.

As discussed further, a barrel seal 45 is aligned with a passage 26 at the alignment module. A channel 44 into the alignment module 20 is capable of fluid communication with the compressed air source, e.g., the cylinder 16 and piston 30. Therefore, the channel 44, the passage 26, alignment module 20 and hopper may be pressurized by the generic compressed air source. In the regard, the alignment module 20 is capable of launching projectile rounds 22, A, B, C, D discussed below, received through a receptacle or hopper defined atop for allowing a plurality of the projectile rounds 22 to be received. A cover 42 to the receptacle is opened for the projectile rounds 22 to be received into a pre-firing area, which is closed for sealing the projectile rounds 22 inside the alignment module 20. The cover and the hopper with the pre-firing area are partially airtight with the cover 42 closed. The received projectiles 22 align by gravity within the pre-firing area to at the barrel seal 45. The trigger actuator linked the compressed air source causes compressed air to expel through the channel 44 into the alignment module 20 and outwardly to launch the one or more received projectile rounds 22 through the barrel seal 45 and the launching barrel 14.

Figure 4:
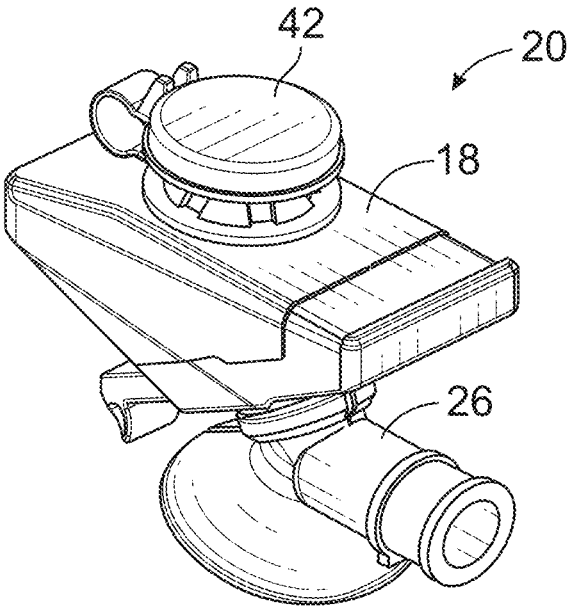
FIGS. 4, 5, 6, and 7 are alignment module embodiments in assembly and section views including receptacle, channel, and barrel seal sections, where
Figure 5:
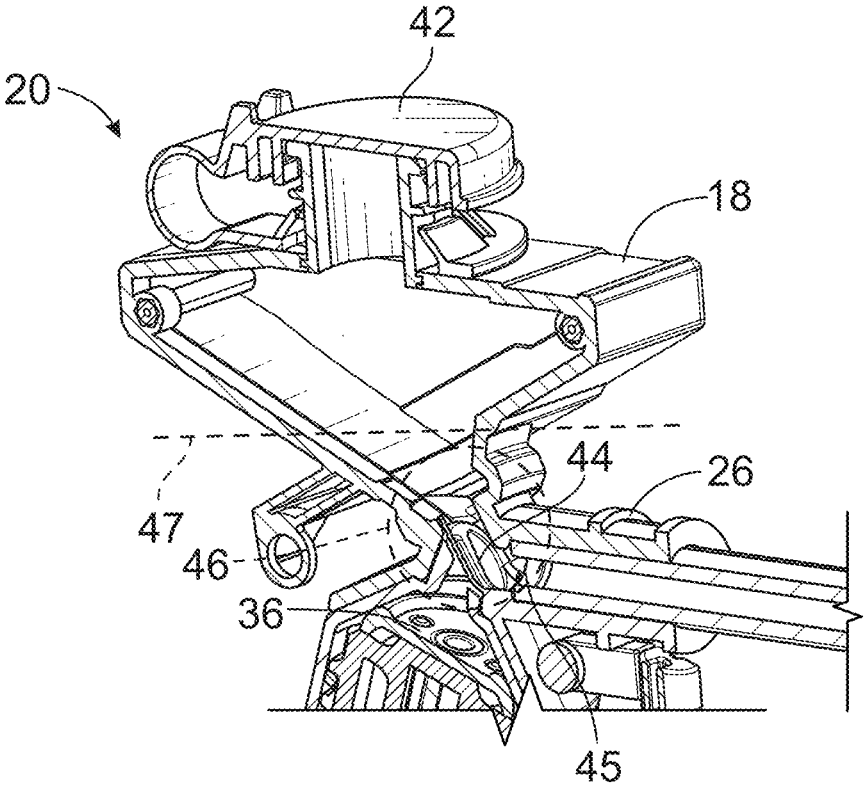
Figure 6:
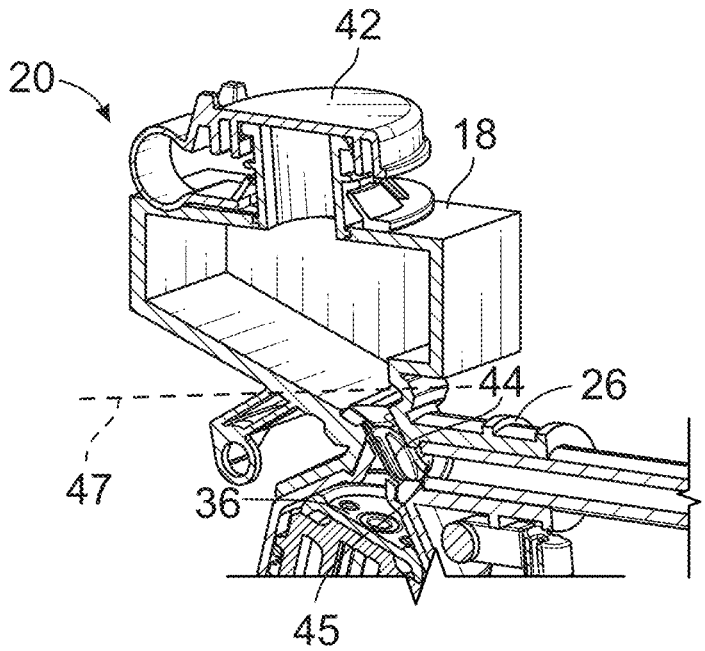
Figure 7:
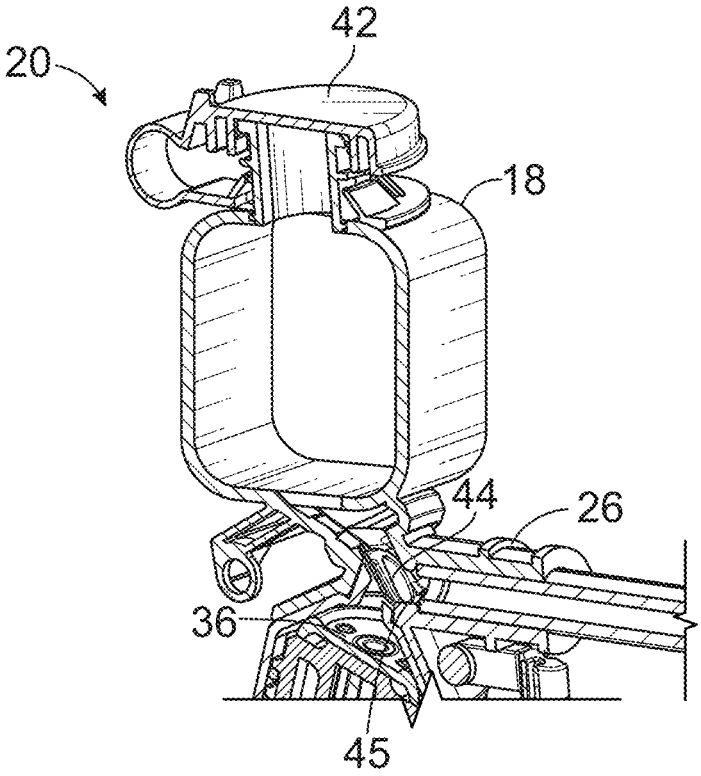

With reference to FIGS. 4, 5, 6, and 7, alignment module 20 embodiments are shown as modular, assembly and with section views. FIG. 4 shows alignment module embodiment 18 with receptacle in the form of a hopper, with the receptacle located along an upper portion. The passage 26 of alignment module 20 aligns with barrel 14. In FIG. 5, a defined pre-firing area is positioned rearward the passage 26, and between the channel 44 intersect with a barrel seal 45 inside the alignment module 20. The pre-firing area may include a junction inside the alignment module 20 extending between the receptacle 18 and channel 44, such that the pre-firing area enables at least one of the received projectiles 22 to align at the at least one barrel seal 45. The receptacle is thus defined on an upper portion, above broken line 47, of the hopper portion of the alignment module 20, with a junction encircled broken line 46 below as a Y junction at an intersection of the receptacle 18, the channel 44, and the barrel seal 45 where each meet together as three branches of the Y junction. The received projectiles 22 align by gravity within the pre-firing area to at the at least one barrel seal 45. An alternate version may facilitate a modified junction between the hopper and the barrel shaped to allow multiple rounds to fire at once a plurality of barrel seals 45. FIG. 7 shows an alternate modular assembly alignment module 20 embodiment shown with a rectangular hopper.

Figure 8:
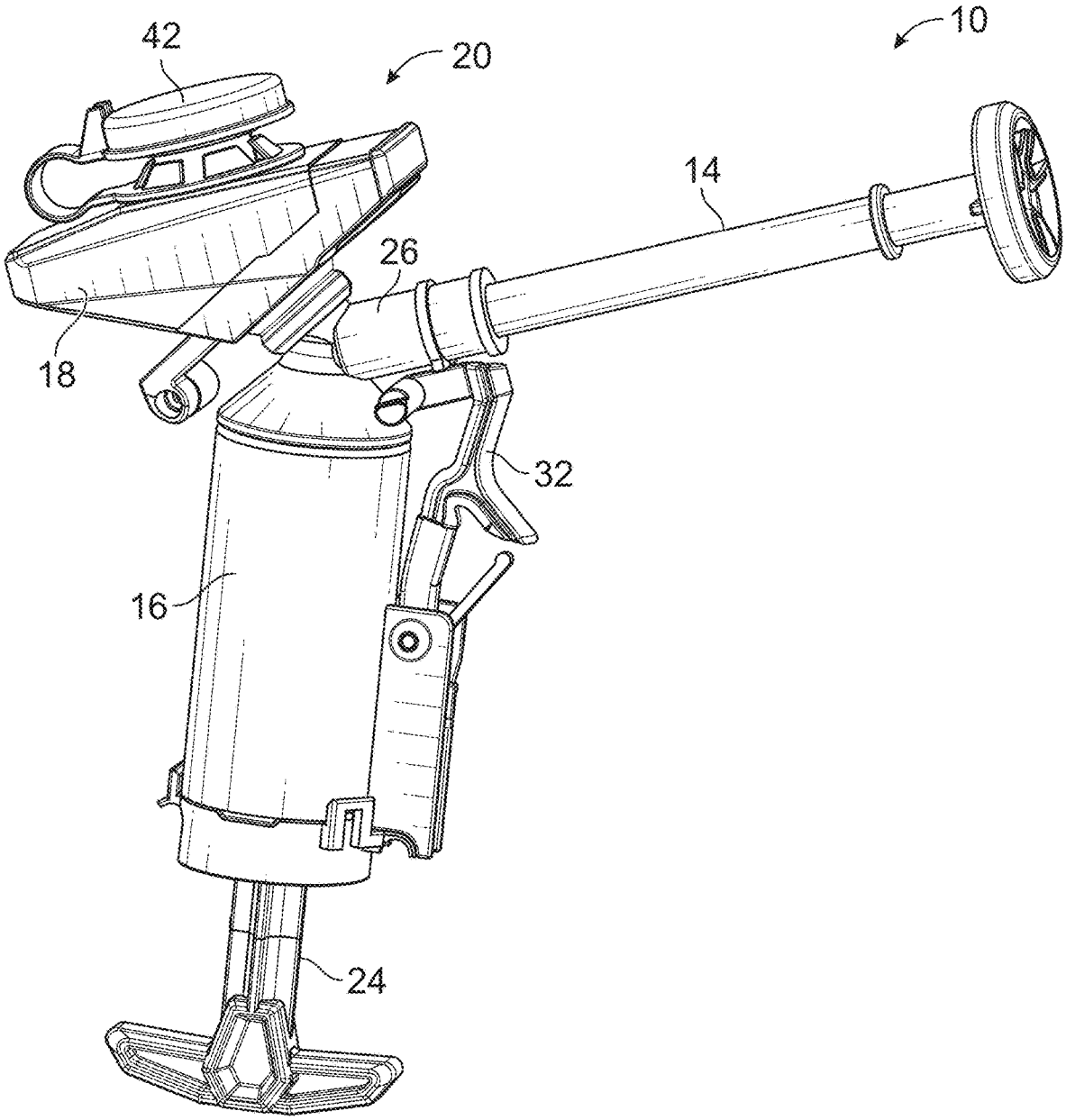
FIG. 8 and FIG. 9 with the blaster housings removed, show the launching apparatus assembly and in cross-section respectively, with FIG. 9 showing initial operation staging of sequenced projectile rounds.
Figure 9:
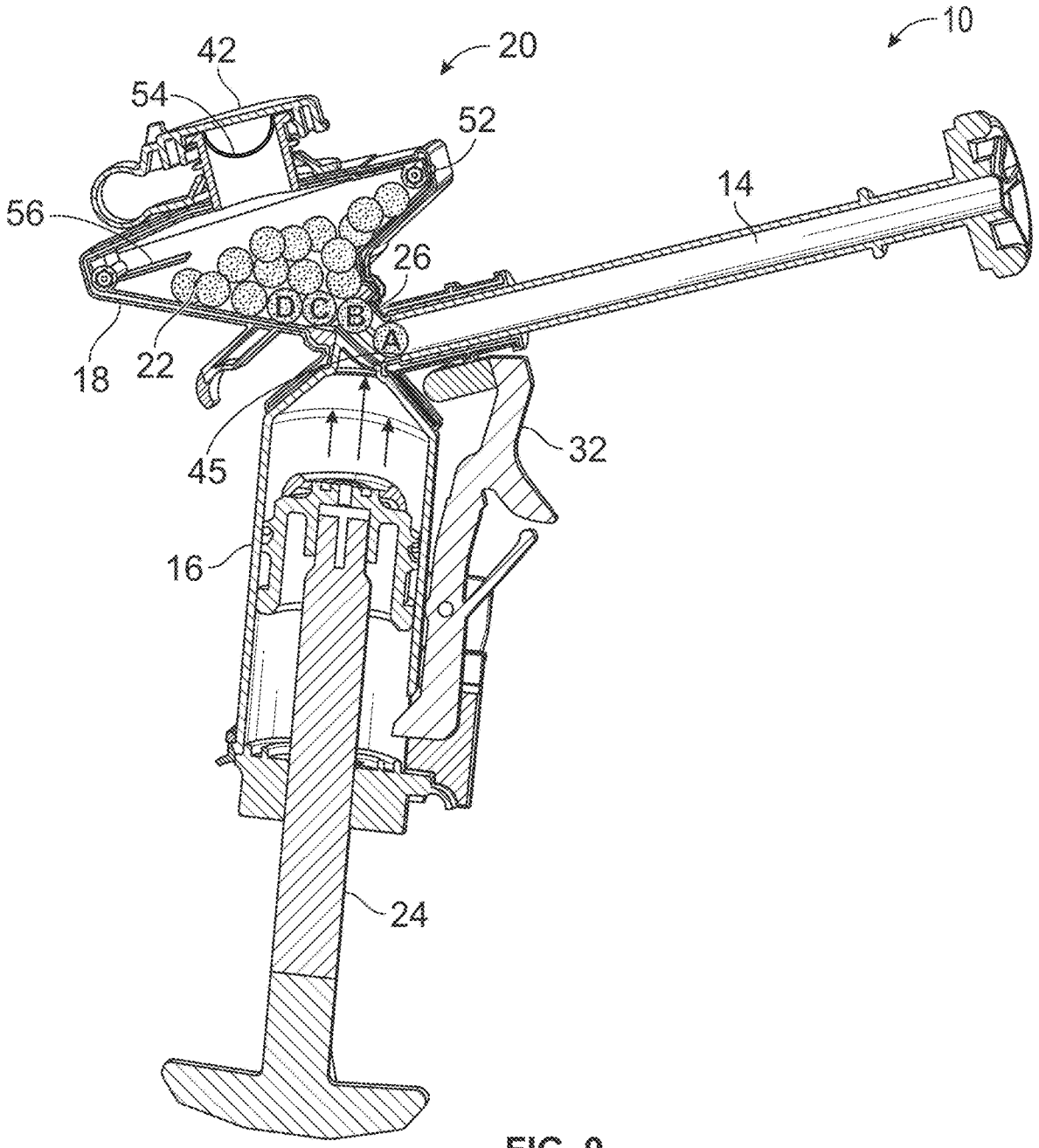
Figure 10:
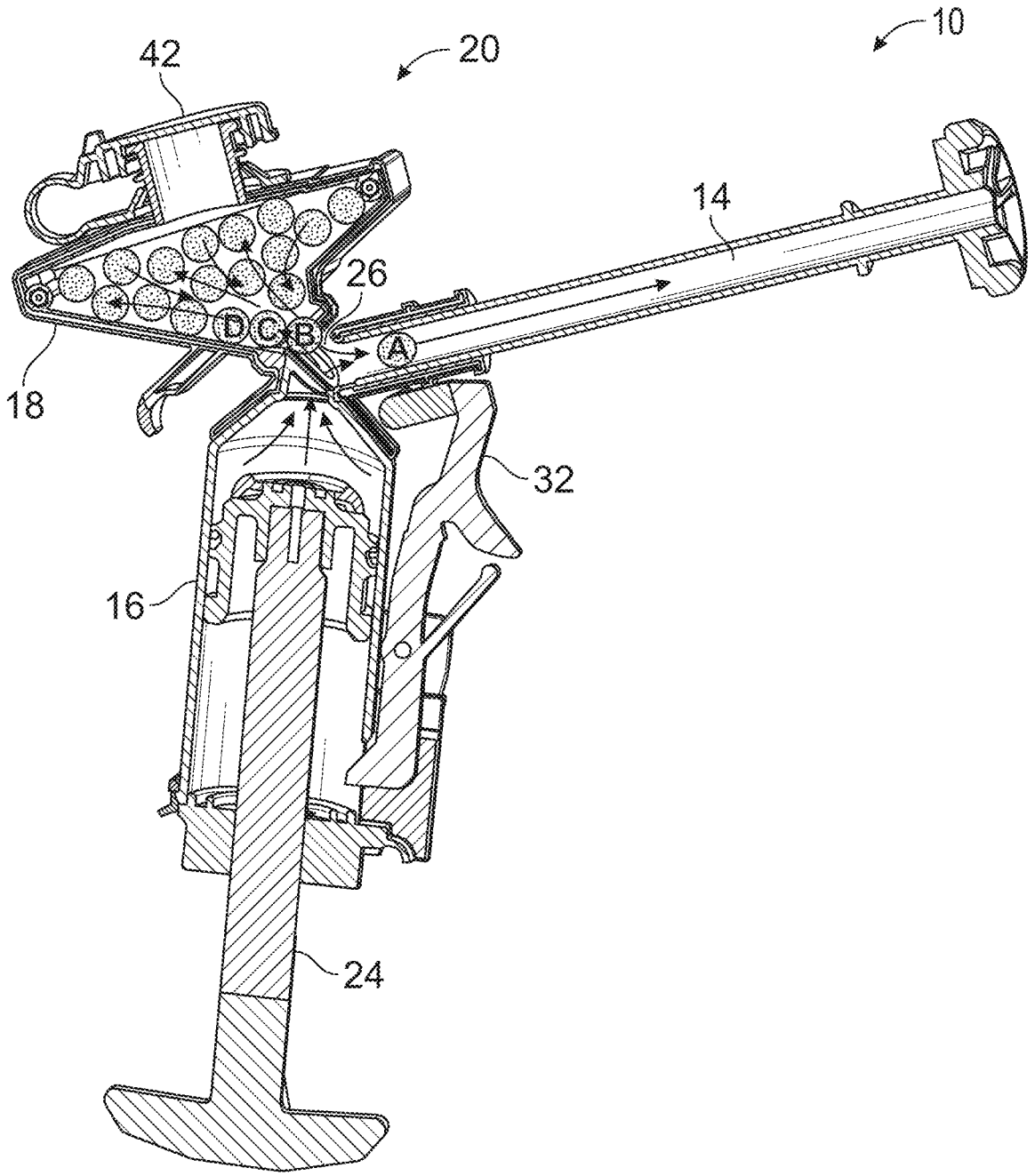
Figure 11:
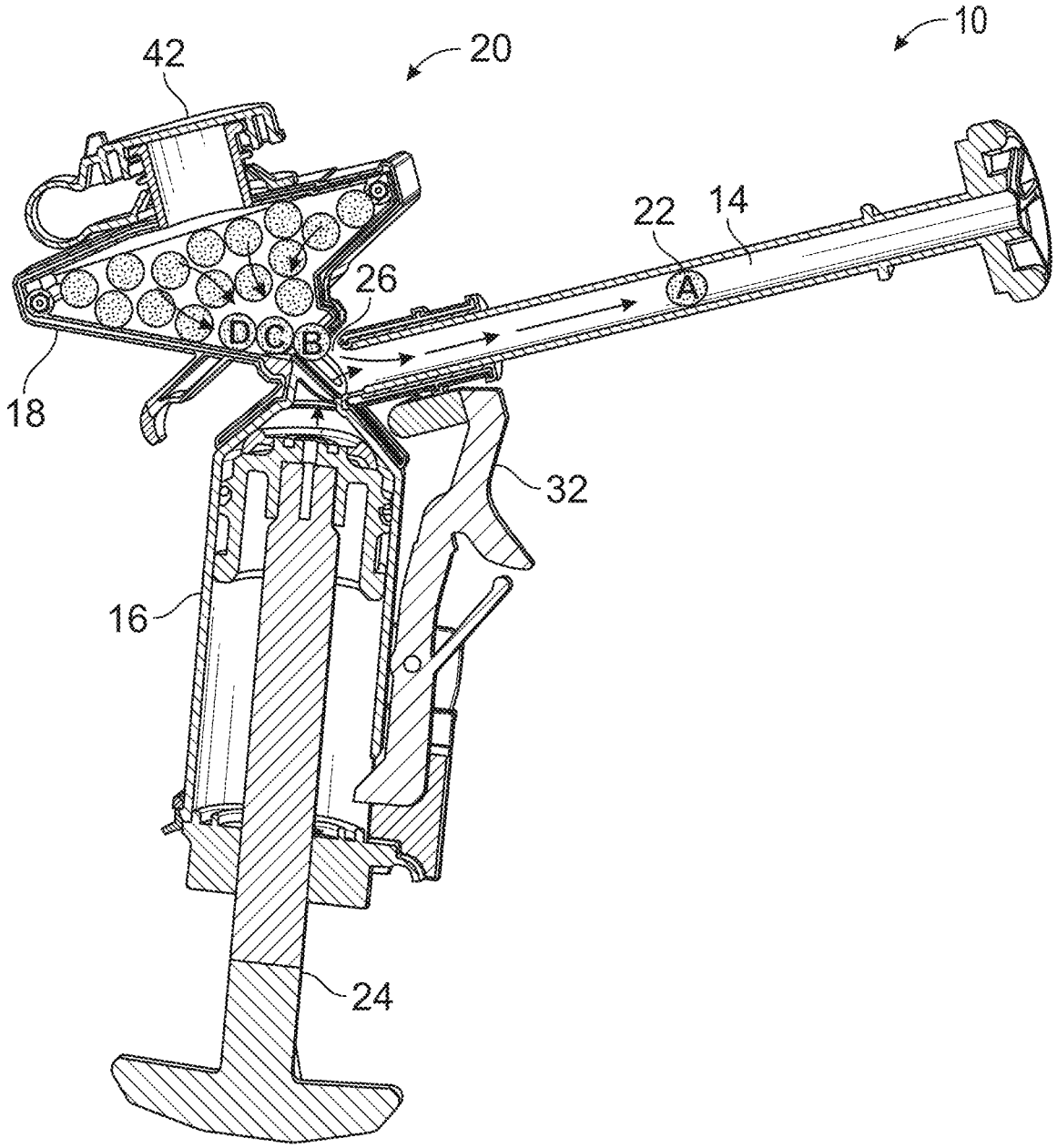
Figure 12:
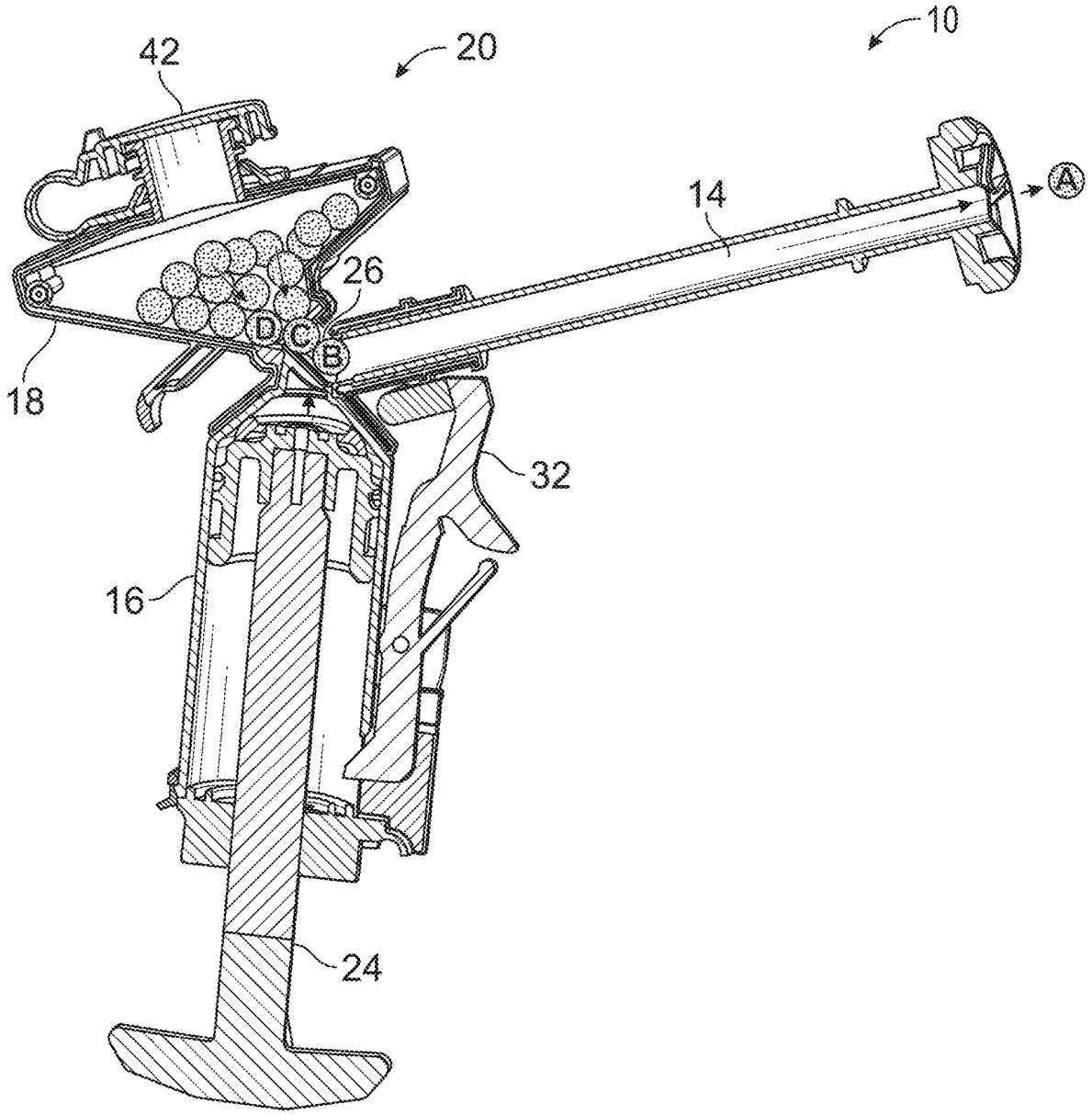
Figure 13:
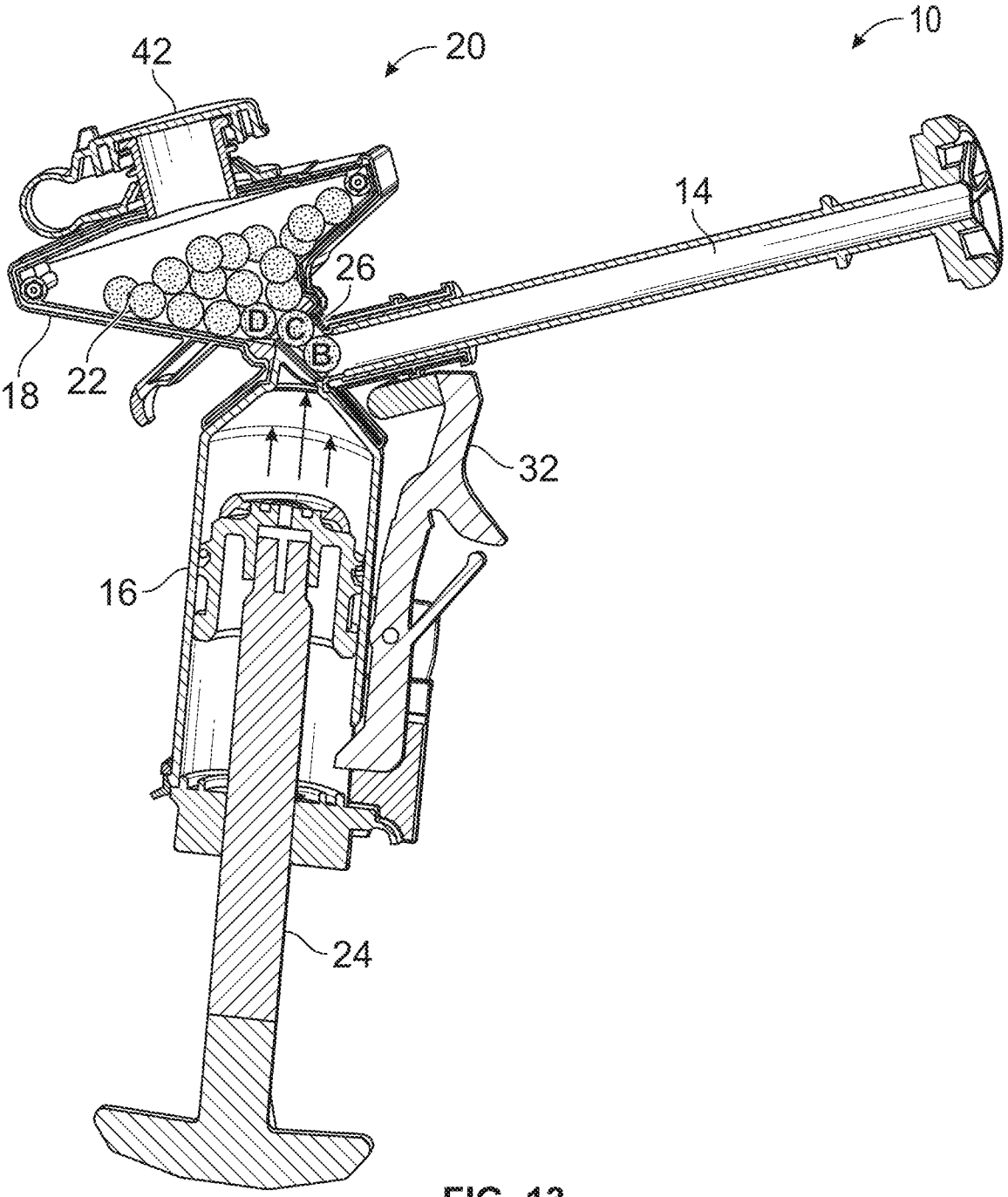

FIG. 8 and FIG. 9 with the blaster housings removed, show the launching apparatus assembly and in cross-section respectively, with FIG. 9 showing initial operation staging of sequenced projectile rounds. As the alignment module 20 and hopper are pressurized during firing, residual air pressure may remain prior to the next round and prevent the next round from being positioned at the barrel seals 45.

Mitigating residual air pressure leaves only sufficient pressure for the next round to be positioned at the barrel seal 45. It is therefore desirable to mitigate residual air pressure. The alignment module may contain a dampening element such as a bleed hole 52, diaphragm 54, or dead space 56 to mitigate residual air pressure from firing. A bleed hole 52 for example will mitigate residual air pressure. The bleed hole 52 is positioned such that there is fluid communication between the hopper and atmosphere above the passage 26. The cross-sectional area of the bleed hole 52 is much smaller than the cross-sectional area of the barrel seal 45, and also much smaller than the hopper cover 42. Of course, the hopper cover 42 is closed or sealed during firing, but sufficient outward pressure remains notwithstanding the bleed hole 52. Therefore, most of the compressed air will expel the one or more projectile rounds at the barrel seal 45. However, some air pressure may be lost to mitigate the residual air pressure after firing. Additionally, or as an alternative, diaphragm 54 may be used to dissipate energy of air flow within the hopper or receptacle, and therefore reduce residual air pressure. The diaphragm 54 may be located with the inside of the hopper cover 42, within the hopper 18, or elsewhere within the alignment module 20. As illustrated in FIG. 9 the diaphragm 54 is shown within the inside of the hopper cover 42. Additionally, or as an alternative, dead space 56 or additional hopper volume may be used. Dead space 56 may be provided by increasing the volume of the hopper. A larger hopper volume causes more air to be pressurized thereby decreasing the average pressure and hence mitigates residual air pressure. Dead space 56 may also be provided in a sufficiently defined area with space within the hopper 18, or between the rounds. Other dampening elements may be employed to mitigate residual air pressure such as the size, shape and dimensions of the hopper, and that a combination of hopper dimensions, bleed hole 52, diaphragm 54 and dead space 56 may be used together. The dampening elements are used to position the projectile round after the shot. Residual air pressure within the hopper 18 may cause a second round to be fired out of the barrel. FIG. 9 also shows the dampening elements, bleed hole 52, diaphragm 54 and dead space 56.

FIGS. 9 through 13 illustrate launching apparatus assembly operations in cross-section staging of sequenced projectile rounds A, B, C, and D. Advantageously, the described embodiments offer a way to shoot gel rounds without the expense and complication of a moving mechanical breech, bolt, or physical barrier, loaded in specific channel, column, magazine which is found in other multi shot capacity pneumatic projectile launchers. To this end, agitation and airflow through the projectiles in the hopper when the compressed air is released by the piston enabled pressurized air to fill the hopper/air path and agitate the rounds 22. The rounds are fed from a generally sealed, pressurized partially airtight, hopper by a combination of gravity and air flow. As a benefit this facilitates an eloquent yet rather simple blaster configuration, while maintaining excellent performance at relatively low cost.

With reference to the staging of sequenced projectile rounds A, B, C, and D in FIGS. 9 through 13, 1.5 rounds in front of the air entry point from the piston. By first pressurizing the hopper the extent to which any additional pressure will start pushing the round out the front of barrel is managed to control how many rounds will fire by changing how many rounds fit single file between the Round Seal Point and the air entry point from the piston. In certain embodiments moving the round seal point closer to the air entry point, and/or removing dead air space in the alternative reduces take up air to be pressurized, adjusting the point of where the rounds sits and the point at which the air is redirected behind the round.

Before Firing:

The round to be fired is just behind the barrel in a "pre-firing area"

The round falls into place due to gravity alone

When Firing:

The air (represented by flow lines) fills the hopper but cannot escape, so it takes the path of least resistance and pushes the round out the barrel. The pressure squeezes the round slightly in the barrel. The barrel is tight enough the round would not fallout on its own.

After Firing:

Gravity brings another round into the pre-firing area at the back of the barrel.

Blaster at rest, note rounds filling the bottom of the hopper because of gravity Blaster during firing, note the rounds have been agitated by the airflow and pushed up to fill the whole hopper. This natural agitation helps prevent balls from getting stuck. It also demonstrates how the air flows through the system. Having the rounds loose in the hopper is advantageous. There may be residual air pressure within the hopper after firing, which may cause the next round to not position correctly at the barrel seal. Dampening elements may be utilized for mitigating the residual air pressure. A bleed hole 52, diaphragm 54, or dead space 56 may be provided to mitigate residual air pressure.

Figure 14:
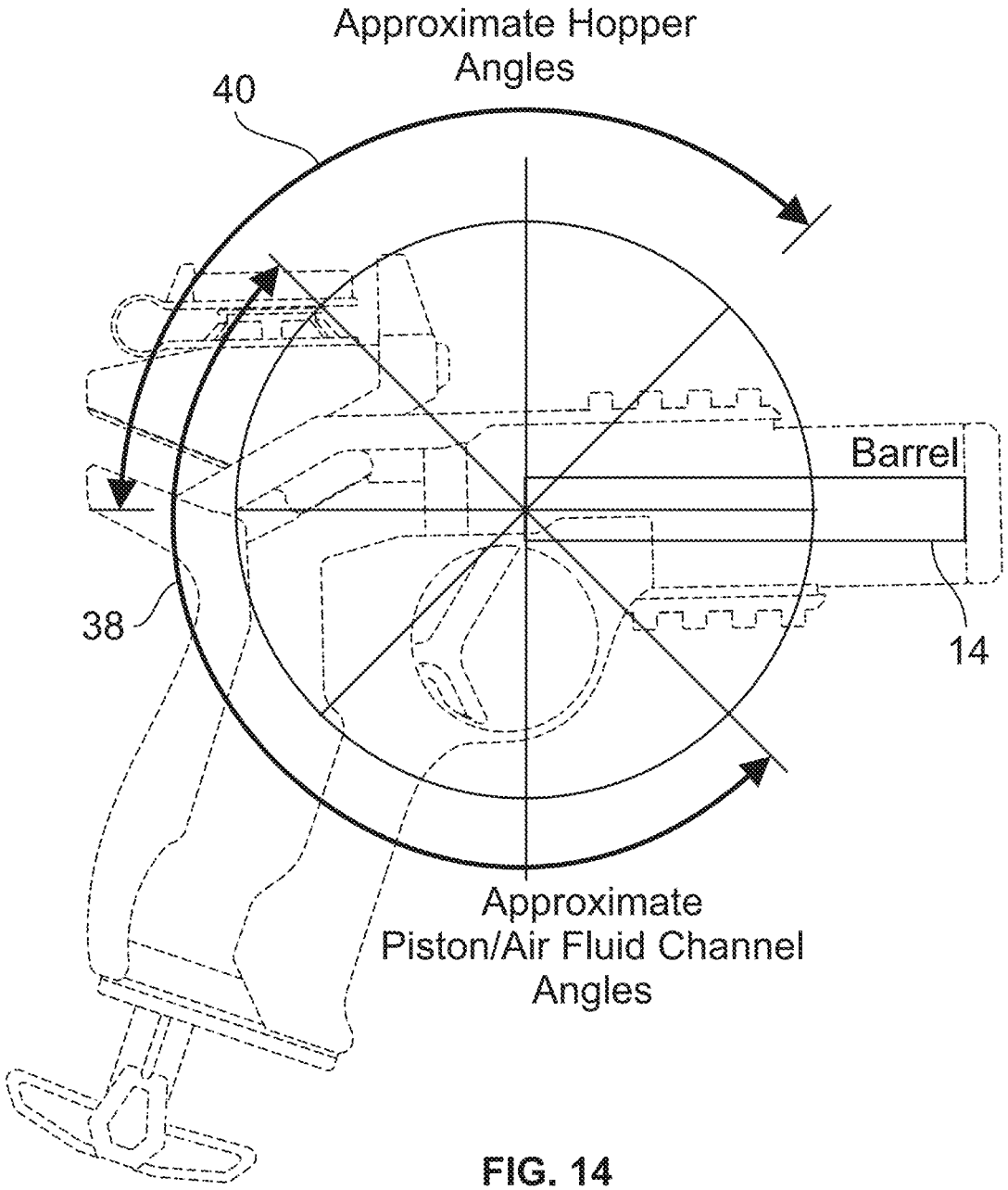
FIG. 14 illustrates approximate hopper receptacle angles and approximate piston/air fluid channel angles in relation to the barrel configuration of toy launching apparatus housing structures with hopper and piston respectively above and below a longitudinal barrel axis.

FIG. 14 concerns options for the piston in-line with the barrel with orientations/angled between the barrel, and the hopper, and the piston/air source. Approximate hopper receptacle angles and approximate piston/air fluid channel angles in relation to the barrel configuration of toy launching apparatus housing structures are considered with hopper and piston respectively above and below a longitudinal barrel axis in the range of +/−40 to 180 degrees and +/−40 to 250 degrees for a wide range of design options for placement of respective hopper and piston structures in relation to the toy launching apparatus shown in broken line background.

Figure 18:
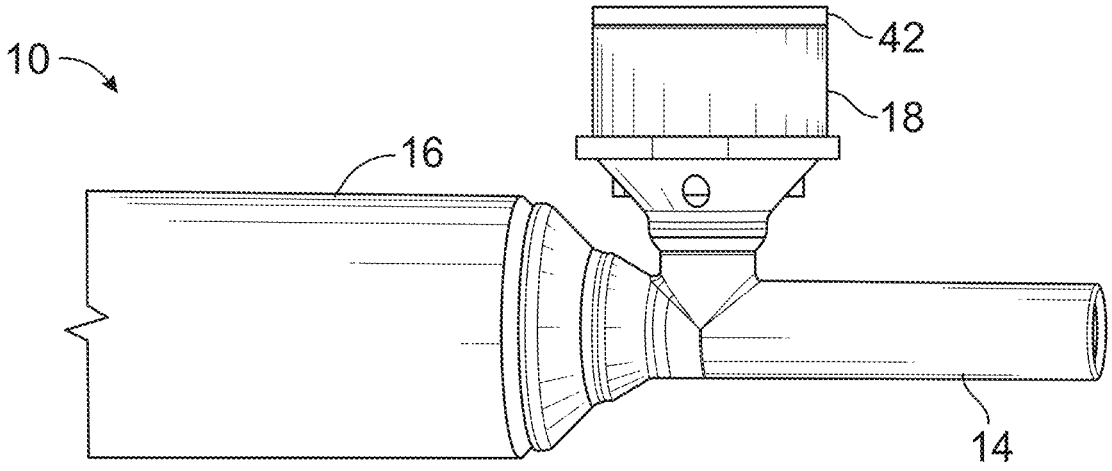
FIG. 18 and FIG. 19 with the blaster housings removed, show the launching apparatus assembly and in cross-section respectively, with reference to FIG. 14 illustrating alternate vertical hopper receptacle and in-line piston/air fluid channel in relation to the barrel configuration of toy launching apparatus firing in-line with the longitudinal axis of barrel 14 from a piston/air fluid channel rearward position.
Figure 19:
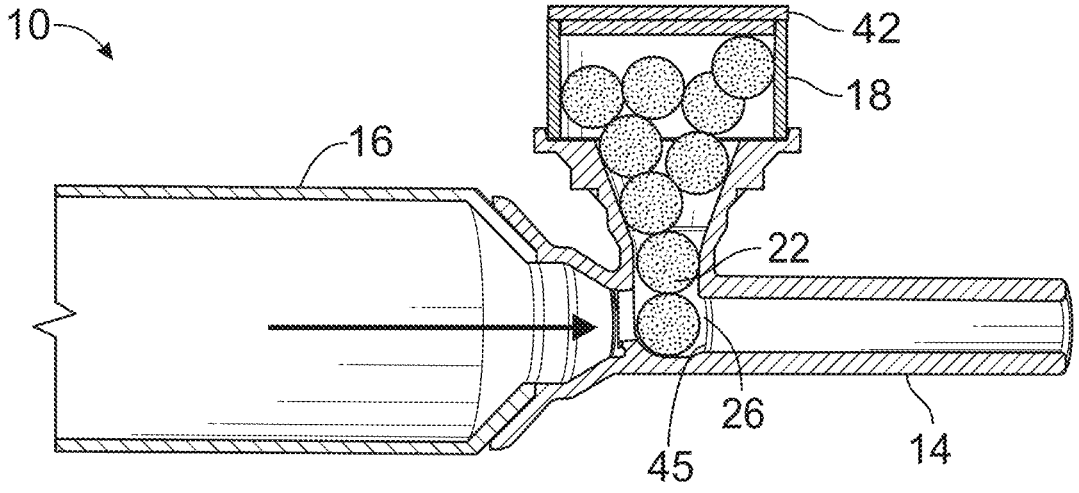
Figure 20:
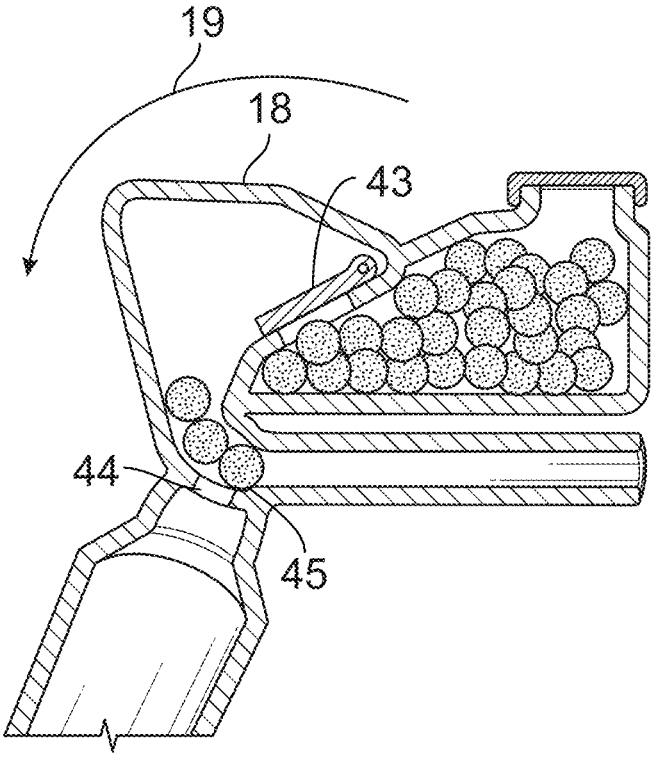
FIGS. 20 through 26 illustrate apparatus assembly operations where separate hopper 18 at the receptacle use extending or rotating flap door alternative interior wall to modify and limit the volume of the hopper for more efficient control over pressure drop resulting before the blast of compressed air reaches the projectile for discharge with the shape of the hopper to reduce the performance drop off between the earlier and later shots from the hopper.
Figure 21:
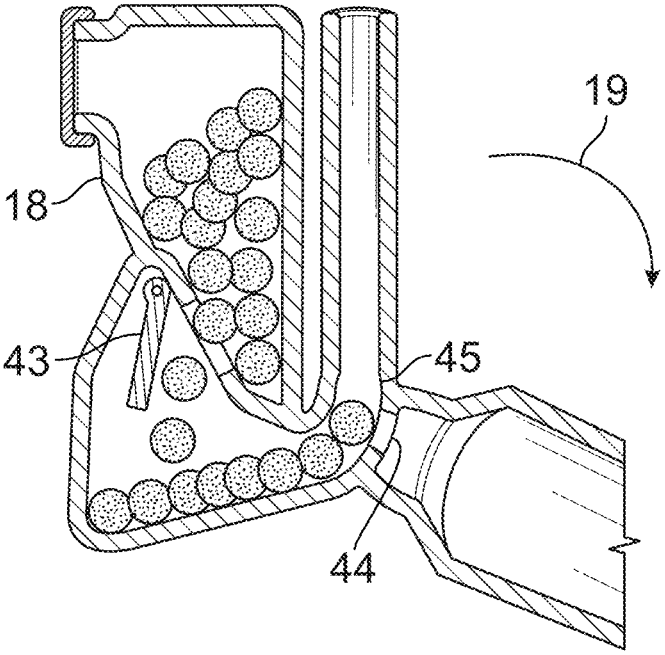
Figure 22:
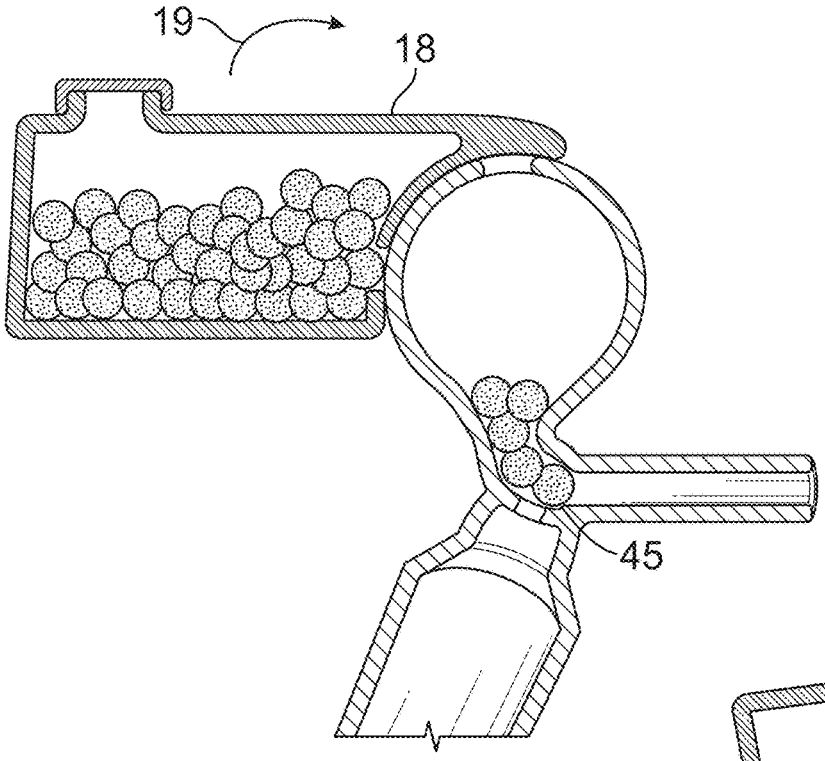
Figure 23:
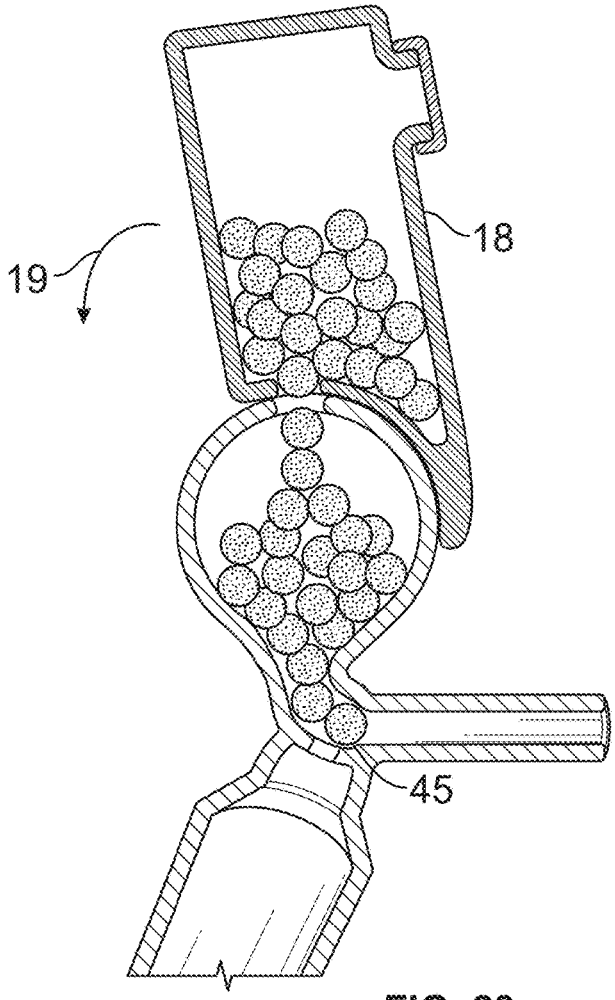

FIG. 18 and FIG. 19 with the blaster housings removed, show the launching apparatus assembly and in cross-section respectively, with reference to FIG. 14 illustrating alternate vertical hopper receptacle and in-line piston/air fluid channel in relation to the barrel configuration of toy launching apparatus firing in-line with the longitudinal axis of barrel 14 from a piston/air fluid channel rearward position.

Figure 15:
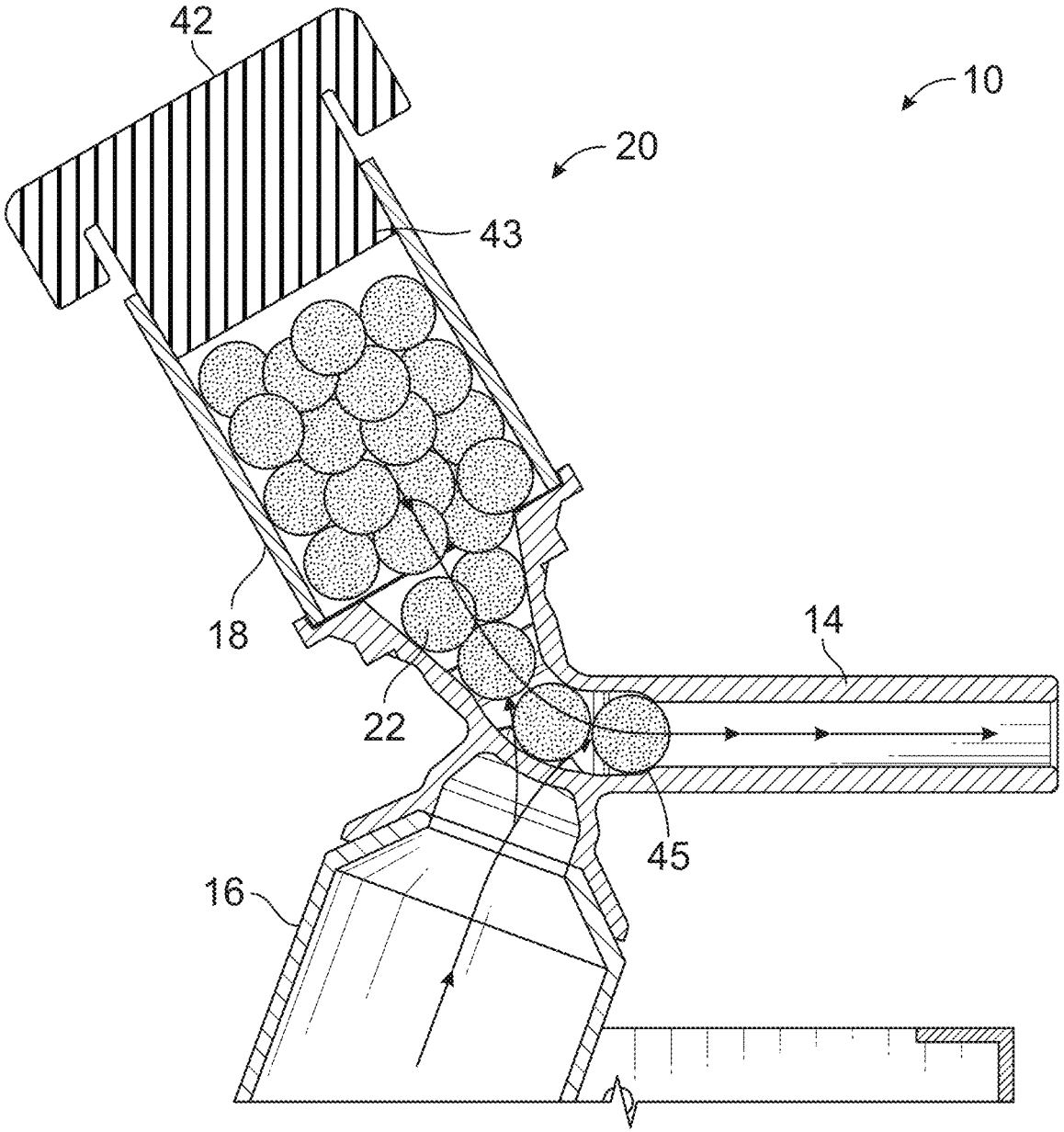
FIGS. 15 through 17 illustrate launching apparatus assembly operations in cross-section staging of sequenced firing plural rounds sequentially in a single launch operation.
Figure 16:
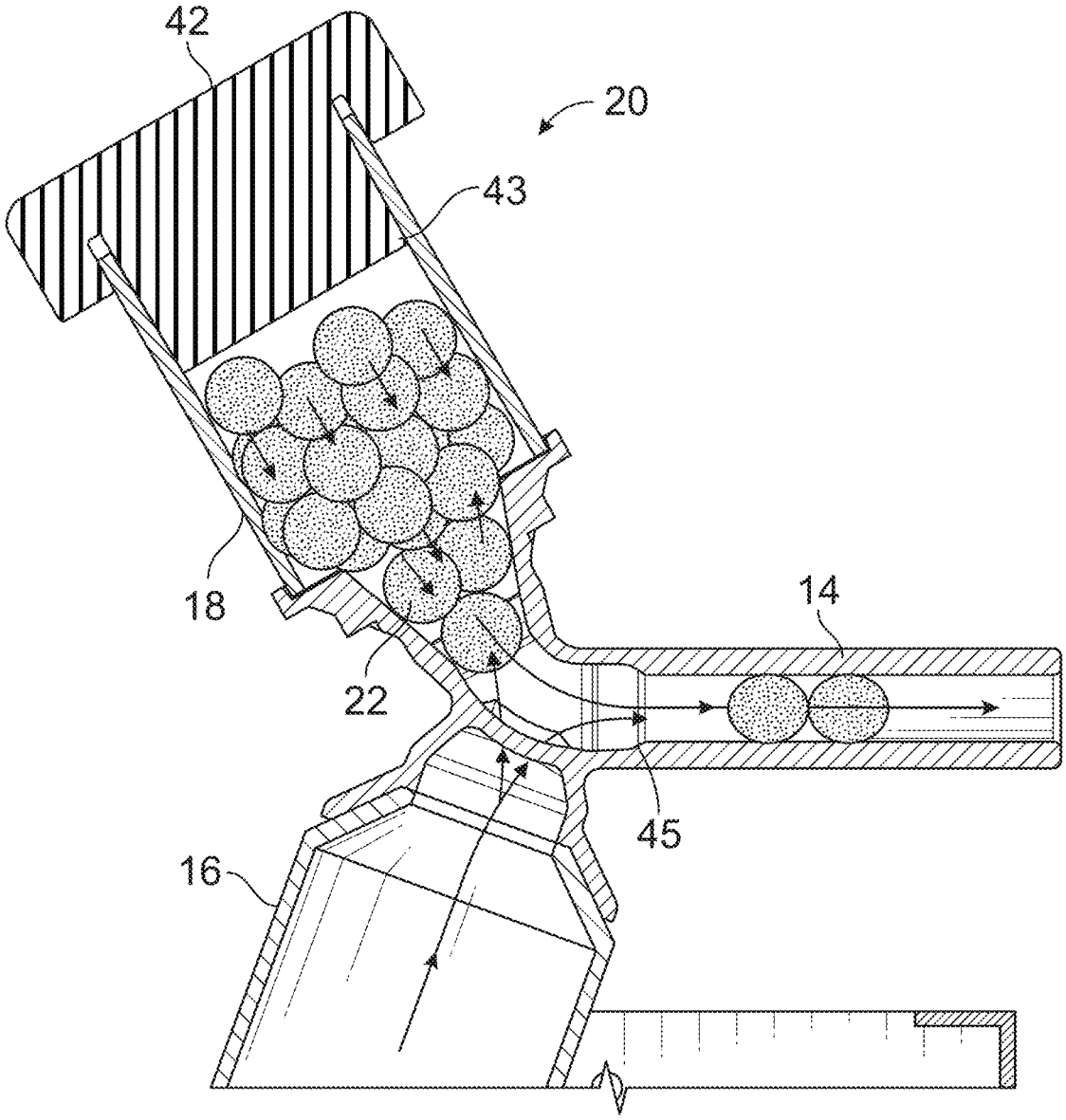
Figure 17:
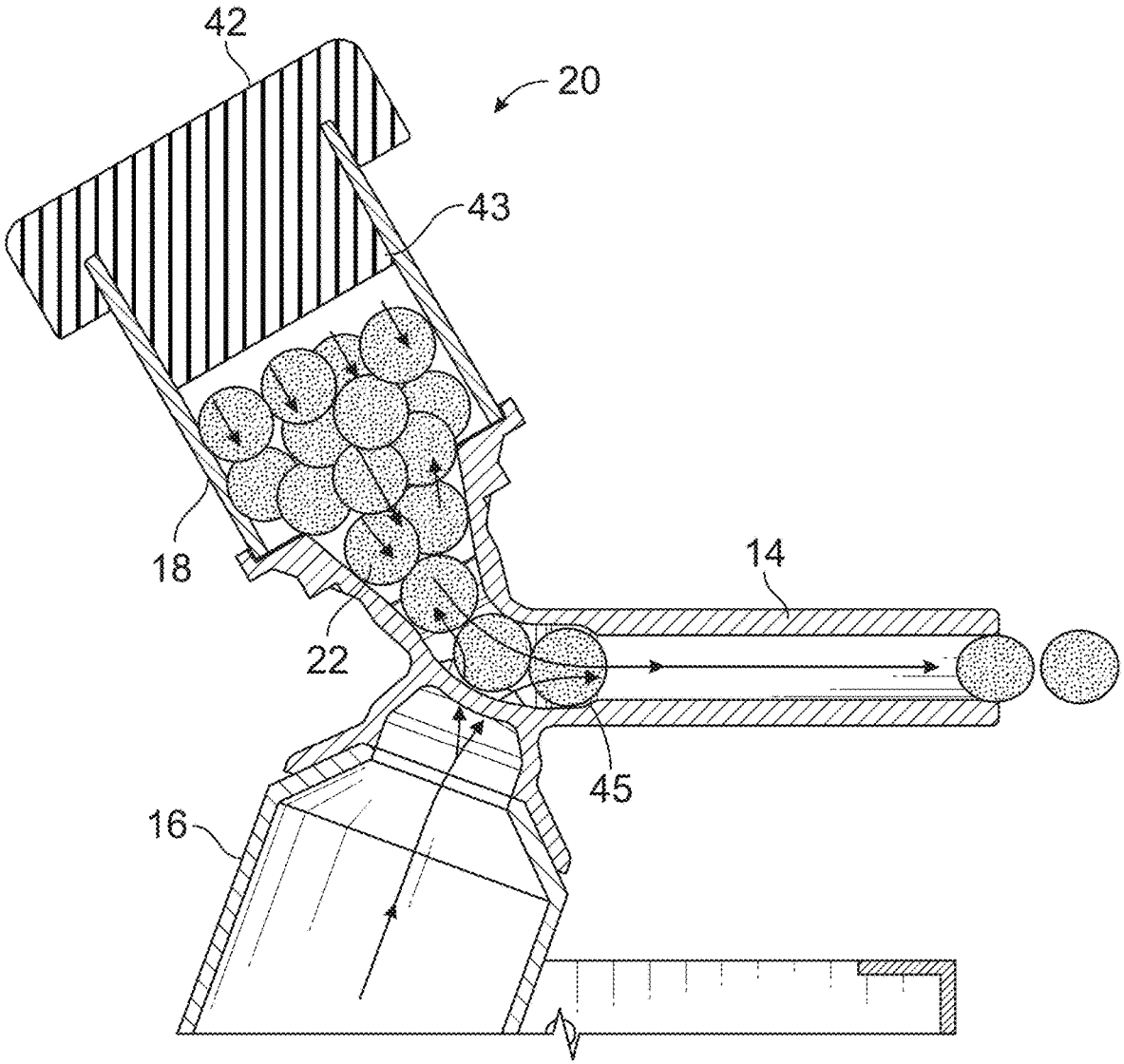

FIGS. 15 through 17 illustrate launching apparatus assembly operations in cross-section staging of sequenced firing of two (2) rounds sequentially in a single launch operation, where the barrel seal 45 is extended into the barrel 14 to accommodate a plurality of rounds or multiple projectile rounds 22; FIGS. 15 through 17 also separately illustrate apparatus assembly operations where separate hopper 18 at the receptacle use an alternate cover 42 with an extending interior wall 43 to modify and limit the volume of the hopper for more efficient control over pressure drop resulting before the blast of compressed air reaches the projectile for discharge with the shape of the hopper to reduce the performance drop off between the earlier and later shots from the hopper. The performance drop off is due to residual air pressure; as more shots are fired, the dead space 56 within the hopper increases as less space is taken by projectiles. With more dead space 56, more residual air pressure is mitigated. Since residual air pressure may contribute to the propulsion of projectiles as more shots are fired, projectiles are propelled less. The at least one of the received projectiles 22 align by gravity within the pre-firing area to at the at least one barrel seal 45. A motorized system version a motor driven compressed air sources, and/or a motorized actuator sub-system.

Figure 24:
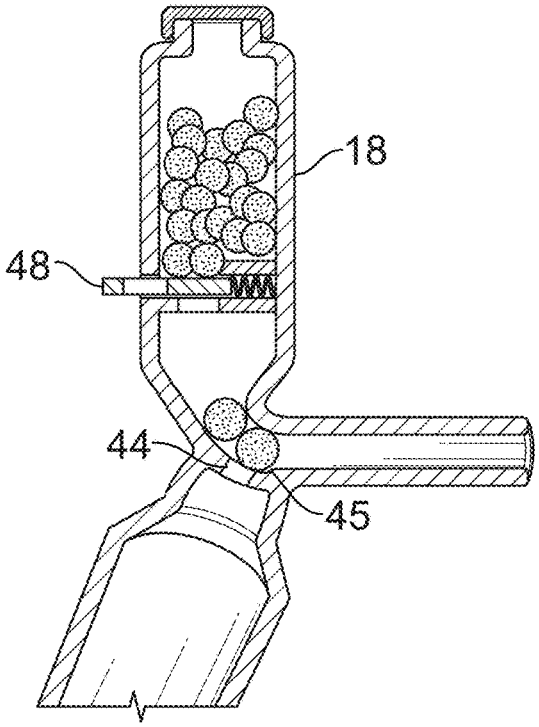
Figure 25:
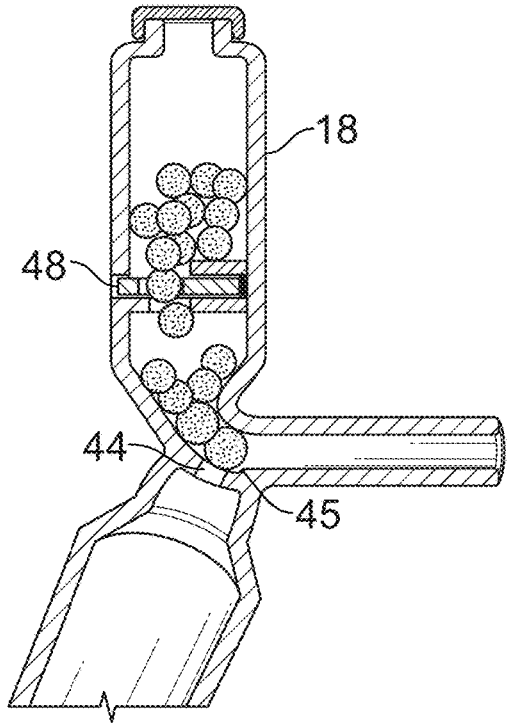
Figure 26:
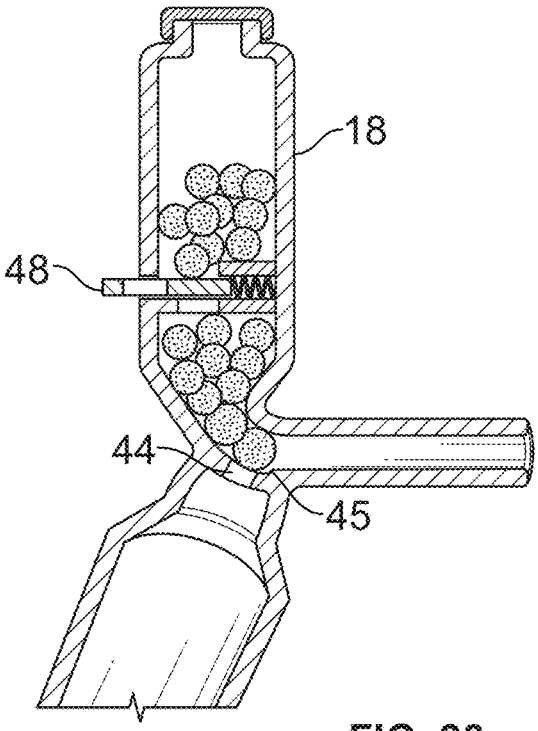

FIGS. 20 through 26 illustrate multiple apparatus assembly geometries, and operations where separate hopper 18 at the receptacle use extending or rotating flap door alternative interior wall 43 to modify and limit the volume of the hopper for more efficient control over pressure drop resulting before the blast of compressed air reaches the projectile for discharge with the shape of the hopper to reduce the performance drop off between the earlier and later shots from the hopper. FIGS. 20 through 23 illustrate operations with reference to FIG. 14 illustrating alternate hopper receptacle configuration, where rotational hopper apparatus along arrow line 19 apparatus assembly operations where separate hopper 18 at the receptacle use extending or rotating flap door/gate wall alternative interior wall 43 to modify and limit the volume of the hopper. FIGS. 24 through 26 illustrate an alternative vertical sectioned hopper apparatus hopper 18 employing extending door interior wall 48 separating the receptacle to modify and limit the volume of the hopper with user finger spring actuated interior door 48 wall extending to close between hopper 18 and the receptacle of the alignment module. Accordingly, the volume of the hopper is managed for more efficient control over pressure drop energy dissipated with respect to relative pressure drop results even before the blast of compressed air reaches the projectile to cause discharge, such that large pressure drop inefficiency is obviated.

The present invention also discloses improved projectile alignment module methods and breechless toy blaster launch apparatus including methods of the making the toy blaster apparatus. The methods include aligning one or more projectile rounds along a passage at the alignment module including at least one barrel seal aligned with a projectile rounds launching barrel; coupling a channel capable of fluid communication with a compressed air source into the alignment module; defining a pre-firing area including a junction inside the alignment module extending between the receptacle, the channel, and the at least one barrel seal thereof, the pre-firing area enabled to align at least one of the received projectiles at the at least one barrel seal; and actuating the channel for causing the compressed air to expel through the channel into the alignment module and outwardly launch the one or more received projectile rounds through the at least one barrel seal and the launching barrel. The receiving of multiple projectile rounds through a receptacle may be further facilitated by providing the receptacle as a hopper to the alignment module with a cover being opened for the one or more projectile rounds received into the pre-firing area; and then closing the cover to the hopper for sealing the one or more projectile rounds inside the alignment module with the pre-firing area being pressurized with the cover closed allowing the compressed air to expel through the channel to the alignment module, to the hopper, and to the one or more projectile rounds for launching outwardly through the at least one barrel seal. After firing, residual air pressure may be left within the hopper which may hinder the positioning of the next projectile round. It may be desirable to reduce the residual air pressure. The dampening elements may be used to reduce residual air pressure and hence position another projectile round at the barrel seal where the projectile round may be fired in another shot.

From the foregoing, it can be seen that there has been provided features for an improved projectile alignment module and breechless toy blaster launch methods and toy air blaster apparatus with a disclosure for the method of the making the toy blaster apparatus. While particular embodiments of the improved safety valve have been shown and described in detail, it will be obvious to those skilled in the art that changes and modifications may be made without departing from the present invention in its broader aspects. Therefore, the aim is to cover all such changes and modifications as fall within the true spirit and scope of the claimed invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. An alignment module for launching projectile rounds, comprising:

a receptacle opening allowing a plurality of the projectile rounds to be received into the alignment module, with the receptacle opening located along an upper portion of the alignment module wherein the alignment module is capable of receiving rounds through said receptacle opening from a receptacle capable of holding multiple projectile rounds;

at least one barrel seal aligned with a passage at the alignment module;

a channel into the alignment module capable of fluid communication with a compressed air source; and a pre-firing area defined to include a junction inside the alignment module extending between the receptacle opening, the channel, and the at least one barrel seal thereof, the pre-firing area enabled to align at least one of the received projectiles at the at least one barrel seal.

2. The alignment module of claim 1, wherein the at least one of the received projectiles align by gravity within the pre-firing area to at the at least one barrel seal.

3. The alignment module of claim 1, wherein the receptacle is defined on an upper portion of the alignment module, and the junction comprises a Y junction wherein the receptacle, the channel, and the at least one barrel seal together represent three branches of the Y junction.

4. The alignment module of claim 1, wherein the receptacle comprises a hopper, with a cover thereto, which is opened for the projectile rounds received into the pre-firing area, and which is closed for pressurizing the projectile rounds inside the alignment module.

5. The alignment module of claim 4, wherein the cover and the hopper with the pre-firing area are pressurized with the cover closed, wherein the alignment module comprises dampening elements such a bleed hole, dead space or diaphragm for reducing air pressure.

6. The alignment module of claim 1, comprising a projectile rounds launching barrel aligned with the at least one barrel seal form a seal with one or more of the projectile rounds for launching from the pre-firing area outwardly through the launching barrel.

7. The alignment module of claim 6, comprising an actuator linked with the compressed air source for causing compressed air to expel through the channel into the alignment module and outwardly launch the one or more received projectile rounds through the at least one barrel seal and the launching barrel.

8. The alignment module of claim 6, wherein the dampening elements of the alignment module cause one or more projectile rounds to be positioned at the barrel seal after compressed air expels one or more other projectile rounds.

9. A method for launching projectile rounds, comprising the steps of:

providing an alignment module and a receptacle opening located along an upper portion of the alignment module;

allowing a plurality of the projectile rounds to be received into the alignment module from the receptacle opening wherein the alignment module is capable of receiving rounds through said receptacle opening from a receptacle capable of holding multiple projectile rounds;

aligning at least one barrel seal with a passage at the alignment module;

extending a channel into the alignment module capable of fluid communication with a compressed air source; and positioning a pre-firing area defined to include a junction inside the alignment module extending between the receptacle opening, the channel, and the at least one barrel seal thereof, the pre-firing area enabled to align at least one of the received projectiles at the at least one barrel seal.

10. The method of claim 9, wherein the at least one of the received projectiles align by gravity within the pre-firing area to at the at least one barrel seal.

11. The method of claim 9, wherein the receptacle is defined on an upper portion of the alignment module, and the junction comprises a Y junction wherein the receptacle, the channel, and the at least one barrel seal together represent three branches of the Y junction.

12. The method of claim 9, providing a cover wherein the receptacle is defined as a hopper with the cover being opened for the projectile rounds received into the pre-firing area, with the cover being closed for pressurizing the projectile rounds inside the alignment module.

13. The method of claim 12, dampening pressure within the pre-firing area of the alignment module when pressurized while the cover is closed on the hopper, with dampening elements provided as a bleed hole, dead space or diaphragm for reducing air pressure wherein the dampening elements of the alignment module cause one or more projectile rounds to be positioned at the barrel seal after compressed air expels one or more other projectile rounds.

14. The method of claim 9, providing a projectile rounds launching barrel aligned with the at least one barrel seal form a seal with one or more of the projectile rounds for launching from the pre-firing area outwardly through the launching barrel, and actuating the compressed air source for causing compressed air to expel through the channel into the alignment module and outwardly launch the one or more received projectile rounds through the at least one barrel seal and the launching barrel.

15. A system for launching projectile rounds, comprising:

an alignment module and a receptacle opening located along an upper portion of the alignment module for a plurality of the projectile rounds to be received into the alignment module from the receptacle opening;

means for receiving rounds through said receptacle opening from a receptacle capable of holding multiple projectile rounds;

at least one barrel seal aligned with a passage at the alignment module;

means for extending a channel into the alignment module capable of fluid communication with a compressed air source; and a pre-firing area defined to include a junction inside the alignment module extending between the receptacle opening, the channel, and the at least one barrel seal thereof, the pre-firing area enabled to align at least one of the received projectiles at the at least one barrel seal.

16. The system of claim 15, wherein the at least one of the received projectiles align by gravity within the pre-firing area to at the at least one barrel seal.

17. The system of claim 15, wherein the receptacle is defined on an upper portion of the alignment module, and the junction comprises a Y junction wherein the receptacle, the channel, and the at least one barrel seal together represent three branches of the Y junction.

18. The system of claim 15, comprising a cover means for the receptacle positioned on a hopper means with the cover means opened for the projectile rounds received into the pre-firing area, with the cover means closed for pressurizing the projectile rounds inside the alignment module.

19. The system of claim 18, comprising pressure dampening means within the pre-firing area of the alignment module when pressurized while the cover means at the hopper is closed, with dampening elements including one or more of a bleed hole, dead space or diaphragm for reducing air pressure wherein the dampening elements of the alignment module cause one or more projectile rounds to be positioned at the barrel seal after compressed air expels one or more other projectile rounds.

20. The system of claim 15, comprising a projectile rounds launching barrel aligned with the at least one barrel seal form a seal with one or more of the projectile rounds for launching from the pre-firing area outwardly through the launching barrel, and comprising actuating means for the compressed air source for causing compressed air to expel through the channel into the alignment module and outwardly launch the one or more received projectile rounds through the at least one barrel seal and the launching barrel.

* * * * *